US007755578B2

(12) United States Patent
Park et al.

(10) Patent No.: US 7,755,578 B2
(45) Date of Patent: Jul. 13, 2010

(54) ORGANIC LIGHT EMITTING DIODE DISPLAY DEVICE AND DRIVING METHOD THEREOF

(75) Inventors: Jae Yong Park, Anyang-si (KR); Kwang Jo Hwang, Anyang-si (KR); Jong Woo Park, Daegu (KR); Hee Dong Choi, Seosan-si (KR); Sang Ho Yu, Seongnam-si (KR); Jin Hyoung Kim, Goyang-si (KR)

(73) Assignee: LG. Display Co., Ltd., Seoul (KR)

( * ) Notice: Subject to any disclaimer, the term of this patent is extended or adjusted under 35 U.S.C. 154(b) by 822 days.

(21) Appl. No.: 11/598,944

(22) Filed: Nov. 14, 2006

(65) Prior Publication Data

US 2007/0120780 A1 May 31, 2007

(30) Foreign Application Priority Data

Nov. 30, 2005 (KR) ..... 10-2005-0115745

(51) Int. Cl.
*G09G 3/30* (2006.01)
*G09G 3/32* (2006.01)
*G09G 3/10* (2006.01)

(52) U.S. Cl. ..... 345/76; 345/82; 315/169.3

(58) Field of Classification Search ..... 345/46–91
See application file for complete search history.

(56) References Cited

U.S. PATENT DOCUMENTS

2003/0020413 A1* 1/2003 Oomura ..... 315/169.3

* cited by examiner

*Primary Examiner*—Sumati Lefkowitz
*Assistant Examiner*—Charles Hicks
(74) *Attorney, Agent, or Firm*—Brinks Hofer Gilson & Lione

(57) ABSTRACT

An organic light emitting diode display device and a driving method are provided. The organic light emitting diode display device comprises a data driver that generates a plurality of reference data voltages that have a level proportional to a gray scale level of a digital data supplied from the timing controller. The data driver supplies the data voltages to the plurality of data lines and compensates for the data voltages in accordance with a magnitude of the feedback voltages from the plurality of pixels fed back through the plurality of feedback lines under control of the timing controller.

15 Claims, 10 Drawing Sheets

ORGANIC LIGHT EMITTING DIODE DISPLAY DEVICE AND DRIVING METHOD THEREOF

This patent document claims the benefit of Korean Patent Application No. P2005-115745 filed in Korea on Nov. 30, 2005, which is hereby incorporated by reference.

BACKGROUND

1. Field

The present embodiments relate to an organic light emitting diode display and a driving method thereof.

2. Related Art

Recently, flat panel display devices have been reduced in weight and bulk and are capable of eliminating some of the disadvantages of a cathode ray tube (CRT). Flat panel display devices include, for example, a liquid crystal display (LCD), a field emission display (FED), a plasma display panel (PDP) and an electro-luminescence (EL) display.

The EL display in such display devices is a self-luminous device capable of light-emitting a phosphorous material by a re-combination of electrons with holes. The EL display device is generally classified into an inorganic EL device using an inorganic compound as the phosphorous material and an organic EL device using an organic compound as the phosphorous material. Such an EL display device has many advantages of, for example, a low voltage driving, a self-luminescence, a thin-thickness, a wide viewing angle, or a fast response speed and a high contrast such that it can be highlighted into a post-generation display device.

The organic EL device is usually comprised of an electron injection layer, an electron carrier layer, a light-emitting layer, a hole carrier layer and a hole injection layer that are disposed between a cathode and an anode. In such an organic EL device, when a predetermined voltage is applied between the anode and the cathode, electrons produced from the cathode are moved, via the electron injection layer and the electron carrier layer, into the light-emitting layer. Holes produced from the anode are moved, via the hole injection layer and the hole carrier layer, into the light-emitting layer. Thus, the electrons and the holes fed from the electron carrier layer and the hole carrier layer emit a light by their re-combination at the light-emitting layer.

Referring to FIG. 1, an active matrix type EL display device using an organic EL device includes an EL panel 20 having pixels 28 arranged at each area defined by intersections between scan lines SL and data lines DL. A scan driver 22 drives the scanning lines SL of the EL panel 20. A data driver 24 drives the data lines DL of the EL panel 20. A gamma voltage generator 26 supplies a plurality of gamma voltages to the data driver 24. A timing controller 27 controls the data driver 24 and the scan driver 22. A power supply 15 supplies a power voltage to the pixels 28.

The EL panel 20 has the pixels arranged in a matrix type. The EL panel 20 is provided with a supply pad 10 that receives a supply voltage VDD from the power supply 15 and a ground pad 12 that receives a ground voltage GND from the power supply 15. The supply voltage VDD supplied to the supply pad 10 is applied to each pixel 28. The ground voltage GND supplied to the ground pad 12 also is applied to each pixel 28.

The scan driver 22 applies a scanning pulse to the scan lines SL to sequentially drive the scan lines SL.

The gamma voltage generator 26 supplies gamma voltage having various voltage values to the data driver 24.

The data driver 24 converts digital data signals inputted from the timing controller 27 into analog data signals with the aid of gamma voltages from the gamma voltage generator 26. The data driver 24 applies the analog data signals to the data lines DL whenever the scanning pulse is supplied.

The timing controller 27 generates a data control signal for controlling the data driver 24 and a scanning control signal for controlling the scan driver 22 with the aid of synchronizing signals supplied from an external system, for example, a graphic card. The data control signal generated from the timing controller 27 is applied to the data driver 24 to thereby control the data driver 24. The scanning control signal generated from the timing controller 27 is applied to the scan driver 22 to control the scan driver 22. The timing controller 27 applies the digital data signals from the external system to the data driver 24.

Each of the pixels 28 receives the data signal from the data line DL when the scanning pulse is applied to the scan line SL, to generate a light that corresponds to the data signal.

A detailed configuration of the pixel 28 is shown in FIG. 2. Referring to FIG. 2, the pixel 28 includes an organic light emitting diode OLED driven with a high-level supply voltage VDD for its driving. A cell driver 28-1 drives the organic light emitting diode OLED. The organic light emitting diode OLED has an anode connected to the supply voltage VDD and a cathode connected to the cell driver 28-1.

The cell driver 28-1 includes a switching thin film transistor T1 being turned on by a scanning pulse applied to the scan line SL to switch a data voltage supplied to the data line DL. A capacitor Cst that charges the data voltage supplied via the switching thin film transistor T1. A driving thin film transistor T2 being turned on by a voltage supplied from the switching thin film transistor T1 or the capacitor Cst to drive the organic light emitting diode OLED.

The driving thin film transistor T2 passes a voltage and a current applied, via the organic light emitting diode OLED, to the drain thereof into a ground connected to the source thereof in a state turned on by a data voltage supplied via the switching thin film transistor T1 or a voltage supplied from the capacitor Cst, thereby driving the organic light emitting diode OLED. Brightness of the organic light emitting diode OLED is proportional to a current amount passed through the driving thin film transistor T2 into the ground.

The driving thin film transistor T2 controlling the brightness of the organic light emitting diode OLED has a threshold voltage that is raised by a deterioration caused by a voltage applied to the gate thereof. Alternatively, the threshold voltage is raised by a peripheral high temperature circumstance because it is made from amorphous silicon. If the threshold voltage is raised in this manner, then brightness of the light emitting diode OLED is lowered because a current amount passed through the driving thin film transistor T2 into the ground is reduced in proportion to the raised threshold voltage value.

An organic light emitting diode display device and a driving method thereof that is capable of automatically compensating for a driving voltage of the organic light emitting diode in accordance with a magnitude of feedback voltages from pixels is desired.

In addition, an organic light emitting diode display device and a driving method thereof that is capable of automatically compensating for a driving voltage of the organic light emitting diode reduced thereby preventing a brightness reduction of the organic light emitting diode is desired.

SUMMARY

In one embodiment, an organic light emitting diode display device includes a display panel having a plurality of first and second scan lines and a plurality of data lines. A plurality of pixels are provided at intersections between the plurality of first and second scan lines and the plurality of data lines and a plurality of feedback lines connected to the plurality of pixels. A timing controller controls an application of first and second scanning pulses supplied to the plurality of first and second scan lines and controls an application of data voltages to the plurality of data lines. A first gate driver sequentially applies the first scanning pulse for selecting the pixel to the plurality of first scan lines under control of the timing controller. A second gate driver sequentially applies the second scanning pulse for controlling the voltage feedback from the plurality of pixels to the plurality of second scan lines under control of the timing controller. A data driver generates a plurality of reference data voltages having a level that is proportional to a gray scale level of a digital data supplied from the timing controller, and for supplying the data voltages to the plurality of data lines and compensates for the data voltages in accordance with a magnitude of the feedback voltages from the plurality of pixels fed back through the plurality of feedback lines under control of the timing controller.

In the organic light emitting diode display device, each of the plurality of pixels provided at the display panel includes a first switching device being turned on by the first scanning pulse to switch the data voltage supplied to the data line. A storage capacitor charges the voltage supplied by the first switching device. An organic light emitting diode that receives a driving current generated by a high-level electric potential supply voltage to make an organic light emission. A second switching device being turned on by a voltage applied via the first switching device or a voltage supplied from the storage capacitor to drive the organic light emitting diode. A third switching device being turned on by the second scanning pulse to switch the driving voltage of the organic light emitting diode into the feedback line.

In one embodiment, the third switching device is a thin film transistor having a gate connected to the second scan line, a drain commonly connected to the second switching device and the organic light emitting diode and a source connected to the feedback line.

In the organic light emitting diode display device, the data driver includes a plurality of reference data generators for generating a plurality of reference data voltages having a level that is proportional to a gray scale level of a digital data supplied from the timing controller. A plurality of data compensators that supply a data voltage to the data line connected to itself among a plurality of data lines and making a differential amplification of a reference data voltage applied to itself among reference data voltages from the plurality of reference data generators on the basis of a feedback voltage fed back through a feedback line connected to itself among a plurality of feedback lines to the data line under control of the timing controller.

In one embodiment, each of the plurality of data compensator includes a first switching device for selectively switching the reference data voltage and the data voltage in response to first and second control signals supplied from the timing controller. A second switching device that selectively switches the feedback voltage from the pixel connected to itself and a negative feedback voltage from the output terminal thereof in response to the first and second control signals. A reset unit that resets the feedback line connected to itself in response to the second control signal. A differential amplifier that makes a differential amplification of a voltage switched by the first switching device and a voltage switched by the second switching device to supply it to the data line.

In one embodiment, the first switching unit includes first and second transmission gates formed by a combination of a PMOS transistor and a NMOS transistor. A common output terminal of the first and second transmission gates is connected to a non-inverted input terminal of the differential amplifier. An input terminal of the first transmission gate is supplied with a reference data voltage from a reference data generator corresponding to itself among a plurality of reference data generators. An input terminal of the second transmission gate is supplied with the data voltage.

In one embodiment, the second switching unit includes third and fourth transmission gates formed by a combination of a PMOS transistor and a NMOS transistor. A common output terminal of the third and fourth transmission gates is connected to an inverted input terminal of the differential amplifier. An input terminal of the third transmission gate is connected to the feedback line. An input terminal of the fourth transmission gate is connected to the output terminal of the differential amplifier.

In one embodiment, the reset unit includes a NMOS transistor having a gate supplied with the second control signal, a drain connected to the feedback line and a source connected to a ground.

In another embodiment, an organic light emitting diode display device includes a display panel having a plurality of first and second scan lines and a plurality of data lines. A plurality of pixels provided at intersections between the plurality of first and second scan lines and the plurality of data lines and a plurality of feedback lines connected to the plurality of pixels. Each of the plurality of pixels includes a first switching device being turned on by a first scanning pulse supplied to the first scan line to switch a data voltage supplied to the data line. A storage capacitor charges the voltage supplied by the first switching device. An organic light emitting diode receives a driving current generated by a high-level electric potential supply voltage to make an organic light emission. A second switching device being turned on by a voltage applied via the first switching device or a voltage supplied from the storage capacitor to drive the organic light emitting diode. A third switching device being turned on by a second scanning pulse supplied to the second scan line to switch the driving voltage of the organic light emitting diode into the feedback line.

In the organic light emitting diode display device, the third switching device is a thin film transistor including a gate connected to the second scan line, a drain commonly connected to the second switching device and the organic light emitting diode and a source connected to the feedback line.

In another embodiment, an organic light emitting diode includes a data driver that supplies a data voltage to a data line. The data driver being configured by a plurality of data compensators that compensates for the data voltage in accordance with a magnitude of a feedback voltage from the pixel fed back through the feedback line in response to a control of the timing controller. Each of the plurality of data compensators includes a first switching device that selectively switches a reference data voltage and a data voltage in response to first and second control signals from a timing controller. A second switching device that selectively switches the feedback voltage and a negative feedback voltage from the output terminal thereof in response to the first and second control signals. A differential amplifier that makes a differential amplification of a voltage switched by the first switching device and a voltage switched by the second switching device and supplies it to the data line. In one embodiment, a reset unit that resets the feedback line in response to the second signal is provided in the organic light emitting diode display device.

In another embodiment, in the organic light emitting diode display device, the first switching device includes first and second transmission gates formed by a combination of a PMOS transistor and a NMOS transistor. A common output terminal of the first and second transmission gates is connected to a non-inverted input terminal of the differential amplifier, an input terminal of the first transmission gate is supplied with the reference data voltage, and an input terminal of the second transmission gate is supplied with the data voltage.

In one embodiment, the second switching device includes third and fourth transmission gates formed by a combination of a PMOS transistor and a NMOS transistor. A common output terminal of the third and fourth transmission gates is connected to an inverted input terminal of the differential amplifier. An input terminal of the third transmission gate is connected to the feedback line. An input terminal of the fourth transmission gate is connected to the output terminal of the differential amplifier.

In another embodiment, the organic light emitting diode display device further includes a reset unit that resets the feedback line in response to the second signal.

In one embodiment, the organic light emitting diode display device includes a NMOS transistor having a gate supplied with the second control signal, a drain connected to the feedback line and a source connected to a ground.

In another embodiment, a method of driving an organic light emitting diode display device includes generating a first scanning pulse to supply it to a first scan line connected to a pixel; supplying a data voltage to a data line connected to the pixel selected by the first scanning pulse; generating a second scanning pulse to supply it to a second scan line connected to the pixel; generating a reference data voltage having a level that is proportional to a gray scale level of the inputted digital data; feeding back a voltage of the pixel through a feedback line during an application time of the second scanning pulse; and compensating for the data voltage supplied to the data line in accordance with a magnitude of a voltage fed back by using the reference data voltage.

In the method, compensating for the data voltage includes feeding back a voltage of the pixel through a feedback line during an application time of the second scanning pulse.

In one embodiment, the method includes resetting the feedback line prior to an application of the second scanning pulse.

In the method, compensating for the data voltage includes making a differential amplification of a reference data voltage on a basis of the feedback to supply it to the data line.

DETAILED DESCRIPTION

Figure 1:
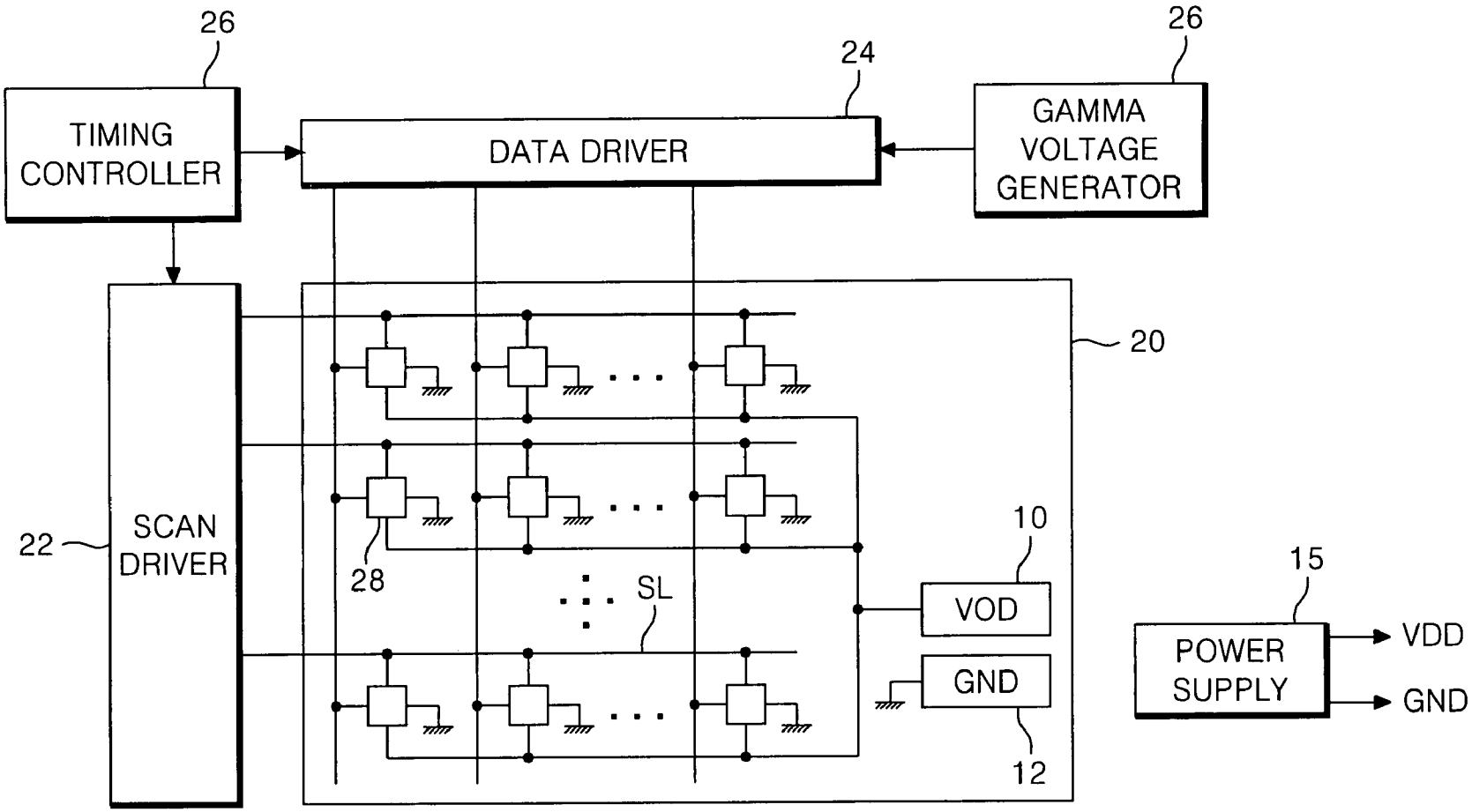
FIG. 1 RELATED ART
FIG. 1 illustrates a block circuit diagram according to a related art organic light emitting diode display device.
Figure 2:
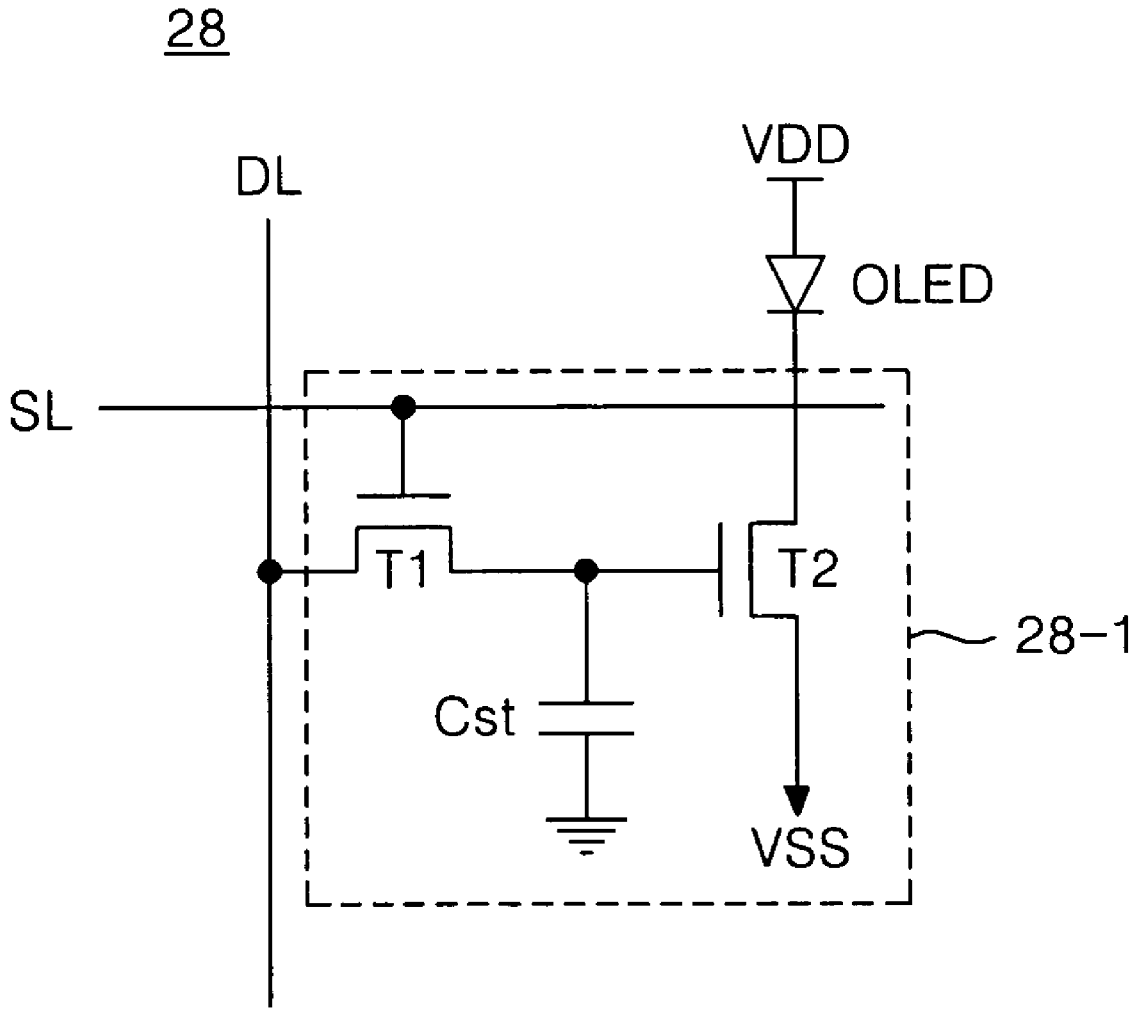
FIG. 2 RELATED ART
FIG. 2 illustrates a circuit diagram of each pixel according to a related art organic light emitting diode display device.
Figure 3:
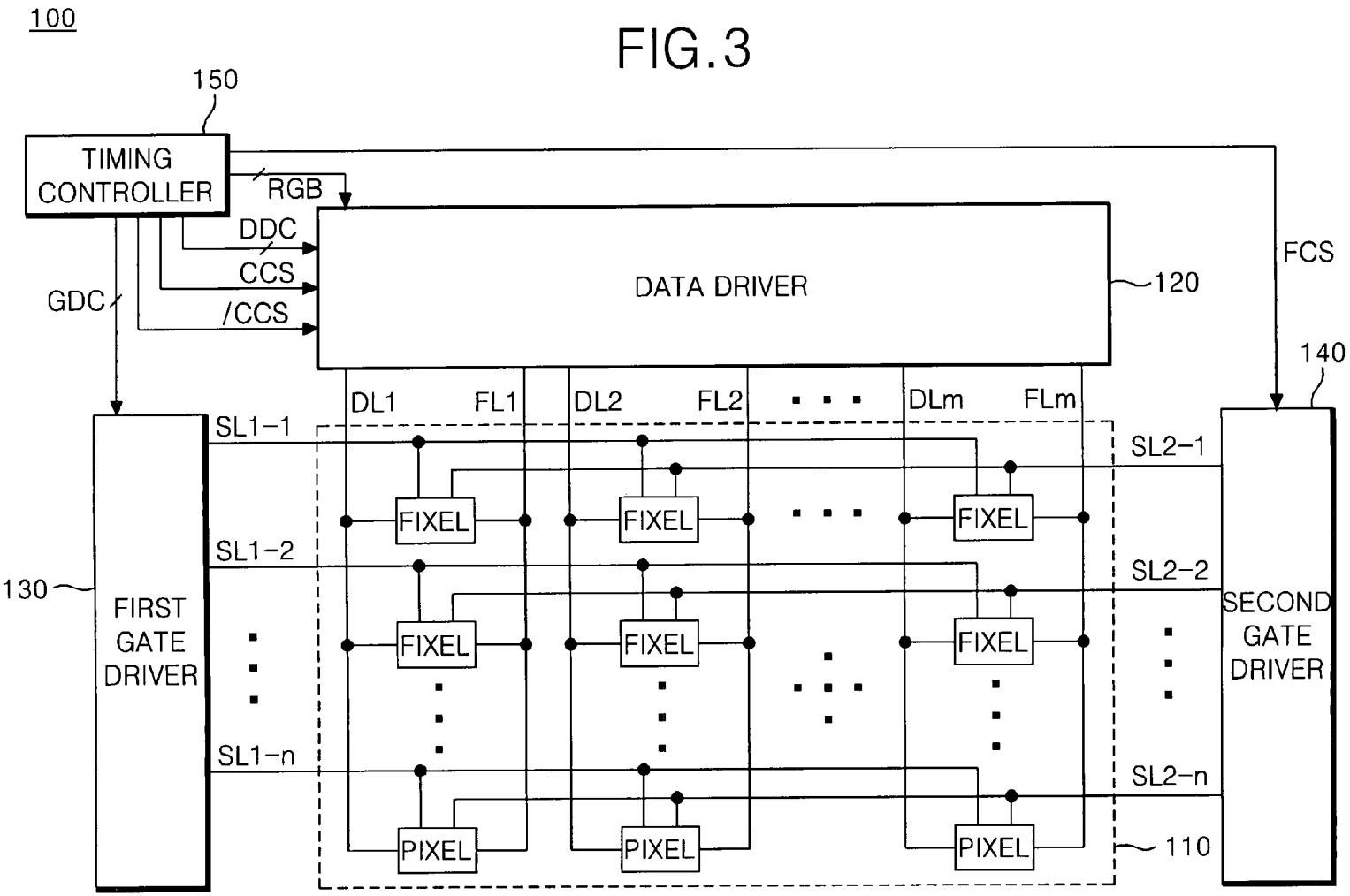
FIG. 3 illustrates a block circuit diagram of an organic light emitting diode display device according to one embodiment.

In one embodiment, as shown in FIG. 3, the OLED display device 100 includes a display panel 110 having n×m pixels arranged in a matrix type at intersections area between n scan lines SL1-1 to SL1-*n* and SL2-1 to SL2-*n* and m data lines DL1 to DLm and m feedback lines FL1 to FLm connected to the pixels. A data driver 120 supplies a data to the data lines DL1 to DLm. A first gate driver 130 sequentially supplies a first scanning pulse to the pixel selecting scan lines SL1-1 to SL1-*n*. A second gate driver 140 sequentially supplies a second scanning pulse to the voltage feedback scan lines SL2-1 to SL2-*n*. A timing controller 150 controls the data driver 120 and the first and second gate drivers 130 and 140.

The display panel 110 is configured by a plurality of pixels selected by the first scanning pulse supplied to the pixel selecting scan lines SL1-1 to SL1-*n* and thereafter driven with a data voltage supplied to the data lines DL1 to DLm to emit an organic light. The display panel 110 feeds back a driving voltage of the pixel selected by the second scanning pulse supplied to the voltage feedback scan lines SL2-1 to SL2-*n*, via the corresponding feedback line of the plurality of feedback lines FL1 to FLm, into the data driver 120. A detailed explanation of the display panel 110 will be made with reference to the attached drawings later.

The data driver 120 converts digital video data RGB into analog video signals in response to a control signal DDC from the timing controller 150 and supplies them to the data lines DL1 to DLm of the display panel 110. The data driver 120 controls a magnitude of data voltages supplied to the data lines DL1 to DLm in accordance with a magnitude of feedback voltages from the pixels of the display panel 110.

Such a data driver 120 includes a plurality of data driving cells 120-1 to 120-*m* that supply data voltages to the data lines DL1 to DLm under control of the timing controller 150 and control a magnitude of data voltages supplied to the data lines DL1 to DLm in accordance with a magnitude of feedback voltages from the pixels of the display panel 110.

Figure 4:
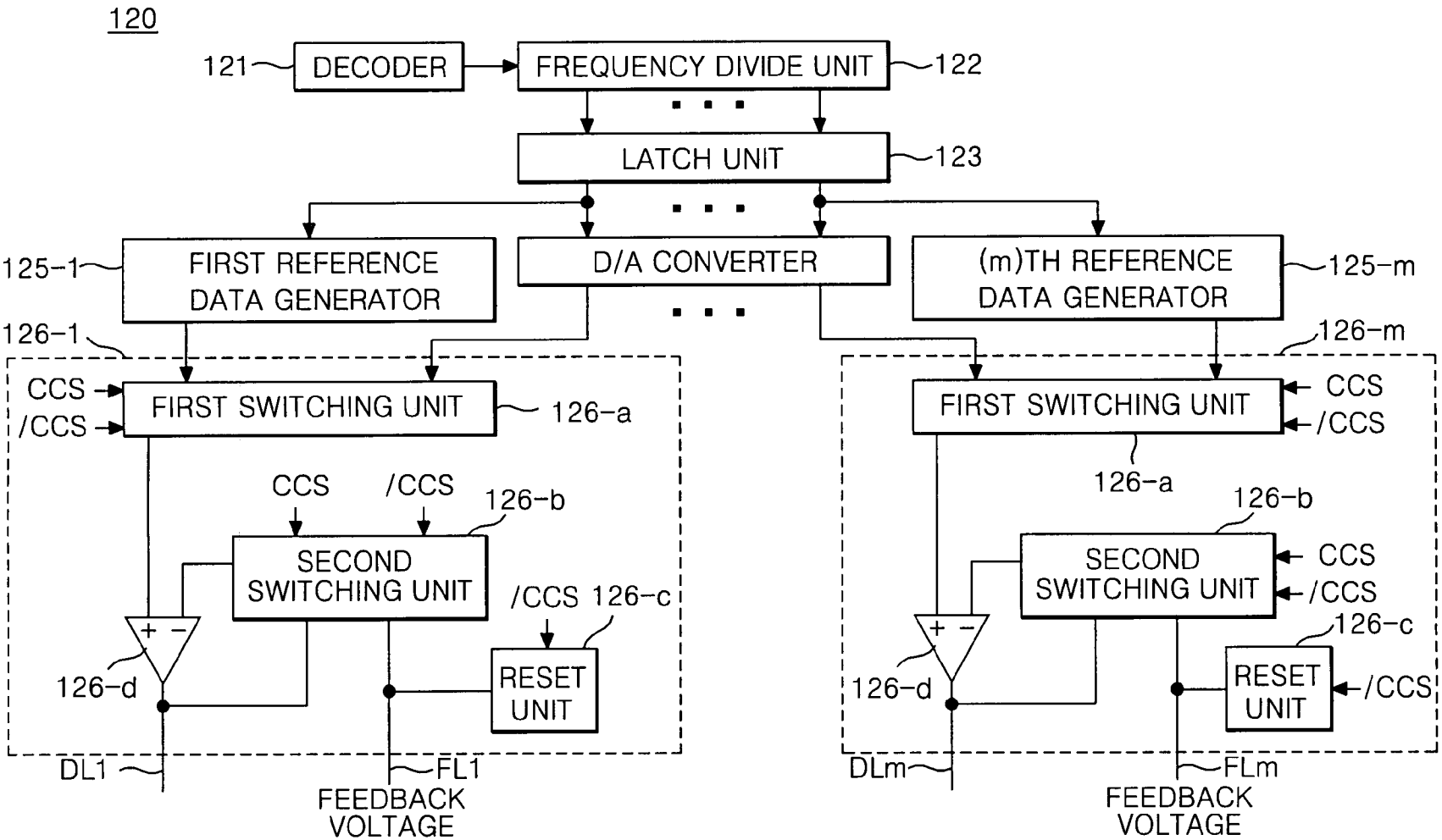
FIG. 4 illustrates a circuit diagram of a data driver shown in FIG. 3.

In one embodiment, as shown in FIG. 4, the first gate driver 130 generates a first scanning pulse that selects the pixel in response to a control signal GDC from the timing controller 150 and sequentially applies the first scanning pulse to the pixel selecting scan lines SL1-1 to SL1-*n*, thereby selecting the pixels of the display panel 110 to be supplied with the data voltage.

The second gate driver 140 sequentially applies a second scanning pulse for making a feedback control in response to a feedback control signal FCS from the timing controller 150 to the voltage feedback scan lines SL2-1 to SL2-*n*, thereby selecting the pixels for feeding back the voltage.

As shown in FIG. 3, the timing controller 150 inputs the digital video data RGB to supply them to the data driver 120, and generates the control signals DDC and GDC using a vertical synchronizing signal Vsync and a horizontal synchronizing signal Hsync inputted in response to a main clock CLK to supply them to the data driver 120 and the first gate driver 130. The control signal DDC of the data driver 120 includes a source start pulse SSP, a source shift clock SSC and a previous voltage/data output control signals Cpvp and /Cpvp, etc. The control signal GDC of the first gate driver 130 includes for example, a gate start pulse GSP, a gate shift clock GSC and a gate output enable signal GOE.

The timing controller 150 applies a compensation control signal CCS and an inverted compensation control signal /CCS for controlling a compensation of the data voltage made by the data driver 120 in accordance with the feedback voltage from the pixel to the data driving cells 120-1 to **120-*m* of the data driver 120, and also applies the feedback control signal FCS for controlling a feedback of the voltage from the pixel configuring the display panel 110 to the second gate driver 140**.

In one embodiment, as shown in FIG. 4, the data driver 120 includes a decoder 121 for decoding the inputted digital data. A data frequency divide unit 122 divides the decoded digital data into the m (m is a natural number more than two) digital data. A latch unit 123 latches the divided m digital data. A D/A converter 124 converts the latched m digital data into the m analog data.

The data driver 120 includes a first to m reference data generators (125-1 to **125-*m*) that generate an analog reference data voltage that is proportional to a gray scale level of a digital data inputted itself among the m digital data outputted from the latch unit 123A first to m data compensators (126-1 to 126-*m*) supply a data voltage converted by the D/A converter 124 to the data line connected to itself and compensating the data voltage supplied to the data line in accordance with a magnitude of a feedback voltage from the pixel fed back through the feedback line connected to itself in response to a control of the timing controller 150**.

The decoder 121 decodes a digital data inputted from the timing controller 150 to make a signal system adapted to the D/A converter 124. For example, if the six digital data from the timing controller 150 input to the decoder 121, then the decoder 121 selects one digital data among the sixty four digital data that assembles the six digital data to output it to the data frequency divide unit 122.

The data frequency divide unit 122 divides a digital data decoded by divide control signals (DCS1 to DCSm) of the timing controller 150 into the m (where m is a natural number more than two) digital data to output it to the latch unit 123.

The latch unit 123 latches the m digital data divided by the data frequency divide unit 122 to output it to the D/A converter 124.

The D/A converter 124 converts the m digital data inputted through the latch unit 123 by using a gamma reference voltage generated from a gamma reference voltage generator (not shown) into the m analog data voltage to output the data voltage to the first to m data compensators (126-1 to **126-*m***).

The first to m reference data generators (125-1 to **125-*m*) generates a reference data voltage that is proportional to a gray scale level of a digital data inputted to itself among the m digital data outputted from the latch unit 123 to output it to the data compensator connected to the output terminal of itself among the first to m data compensators (126-1 to 126-*m*). The first to m reference data generators (125-1 to 125-*m*) and the first to m data compensators (126-1 to 126-*m*) are connected to each other in a one-to-one relationship. For example, the first reference data generator 125-1 outputs the reference data voltage to the first data compensator 126-1, and the m reference data generator 125-*m* outputs the reference data voltage to the m data compensator 126-*m*. Alternatively, the first to m reference data generators (125-1 to 125-*m*) are generally supplied with a digital data outputted from the latch unit 123 to generate a reference data voltage, but it is not necessary to define by this. For example, the first to m reference data generators (125-1 to 125-*m*) are supplied with a digital data decoded by the decoder 121 or a digital data divided by the data frequency divide unit 122 or a data voltage outputted from the D/A converter 124** to may be implemented in such a manner to generate a reference data voltage.

The first to m data compensators (126-1 to **126-*m*) have an input terminal connected to one output terminal among the output terminals of the D/A converter 124 one-to-one relationship, an input terminal connected to an output terminal of a reference data generator corresponding to itself among the first to m reference data generators (125-1 to 125-*m*), and a feedback terminal connected to one feedback line corresponding to itself among feedback lines (FL1 to FLm). Also, the first to m data compensators (126-1 to 126-*m*) have an output terminal connected to one data line corresponding to itself among a plurality of data lines (DL1** to DLm).

The first to m data compensators (126-1 to **126-*m*) have a linked structure that supplies a data voltage converted by the D/A converter 124 to the data line connected to itself and compensates a data voltage supplied to the data line using a reference data supplied from a reference data generator corresponding to itself among the first to m reference data generators (125-1 to 125-*m*) in accordance with a magnitude of a feedback voltage fed back through the feedback line connected to itself in response to a control of the timing controller 150**.

In one embodiment, the first to m data compensators (126-1 to **126-*m*) supply a data voltage converted by the D/A converter 124 to the data line during a half period of a scanning pulse supplied from the first gate driver 130 to the gate line. The first to m data compensators (126-1 to 126-*m*) compensates a data voltage supplied to the data line or maintains the data voltage supplied to the data line in a data voltage level outputted from the D/A converter 124** in accordance with a feedback voltage during another half period of the scanning pulse.

In one embodiment, each first to m data compensators (126-1 to **126-*m*) includes a first switching unit 126-*a* for selectively switching a reference data voltage from a reference data generator connected to itself among the first to m reference data generators (125-1 to 125-*m*) in accordance with the compensation control signal CCS and an inverted compensation control signal /CCS supplied from the timing controller 150, and a data voltage from the D/A converter 124, a second switching unit 126-*b* for selectively switching a feedback voltage from the pixel corresponding to itself among the pixels and a negative feedback voltage from the output terminal thereof in accordance with the compensation control signal CCS and the inverted compensation control signal /CCS supplied from the timing controller 150, a reset unit 126-*c* that resets the feedback line connected to itself among the feedback lines FL1 to FLm connected to the pixels in accordance with the inverted compensation control signal /CCS supplied from the timing controller 150, and a differential amplifier 126-*d* for making a differential amplification of a voltage switched by the first switching unit 126-*a* and a voltage switched by the second switching unit 126-*b***.

In one embodiment, all of the pixels of the display panel 110 have the same circuit configuration and operation, and all of the configuration elements **126-*a*, 126-*b*, 126-*c* and 126-*d* of the first to m data compensators (126-1 to 126-*m*) have the same circuit configuration and operation. A circuit configuration of the pixel is connected to the scan lines SL1-1 and SL2-1, the data line DL1 and the feedback line FL1 are among the plurality of pixels and a circuit configuration of the first data compensator 126-1** supplying the data voltage to this pixel and compensating this voltage.

Figure 5:
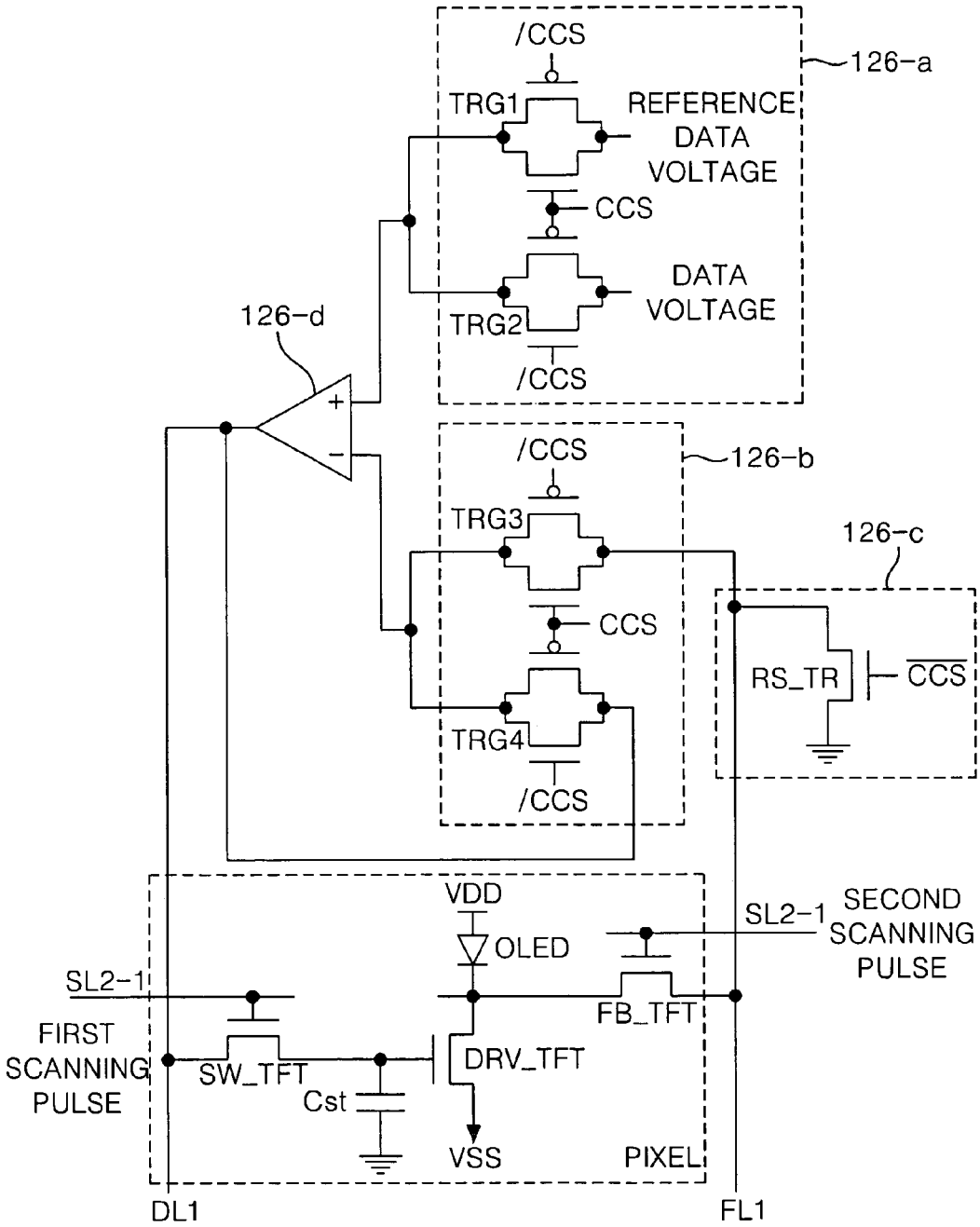
FIG. 5 is a circuit diagram that illustrates a display panel shown in FIG. 3, a first and second switching unit and a reset unit shown in FIG. 4.

As shown in FIG. 5, the pixel of the display panel 110 includes a switching thin film transistor SW_TFT being turned on the first scanning pulse applied to the scan line SL-1 to switching a data voltage supplied to the data line DL1. A storage capacitor Cst charges the data voltage supplied via the switching thin film transistor SW_TFT. An organic light emitting diode OLED is driven by a driving current generated by a high-level electric potential supply voltage VDD when a current path is formed within the pixel for its light emitting. A driving thin film transistor DRV_TFT is turned on by a voltage supplied from the switching thin film transistor SW_TFT or the storage capacitor Cst to drive the organic light emitting diode OLED. A feedback thin film transistor SW_TFT is turned on by the second scanning pulse applied to the scan line SL2-1 to feed back a driving voltage of the organic light emitting diode OLED into the feedback line FL1.

The switching thin film transistor SW_TFT has a gate connected to the scan line SL1-1, a drain connected to the data line DL1, and a source commonly connected to the storage capacitor Cst and the gate of the driving thin film transistor DRV_TFT. The switching thin film transistor SW_TFT is turned on when the first scanning pulse outputted from the first gate driver 130 is applied, via the scan line SL1-1, to the gate thereof. When a data voltage supplied from the data compensator 126-1 is applied, via the data line DL1, to the drain thereof in this state, the switching thin film transistor SW_TFT switches the data voltage into the source thereof to supply it to the capacitor Cst and the driving thin film transistor DRV_TFT.

The storage capacitor Cst has one terminal commonly connected to the source of the switching thin film transistor SW_TFT and the gate of the driving thin film transistor DRV_TFT and other terminal connected to a ground, for example, the ground VSS. After the storage capacitor Cst is charged by the data voltage supplied via the switching thin film transistor SW_TFT, it discharges the charged voltage when a voltage supply from the switching thin film transistor SW_TFT is stopped to supply it to the gate of the driving thin film transistor DRV_TFT.

The organic light emitting diode OLED has an anode connected to the supply voltage VDD and a cathode connected to the drain of the driving thin film transistor DRV_TFT. The organic light emitting diode OLED is driven with the driving current applied to the anode thereof to make an organic light emission of it when a current path is formed by the driving thin film transistor DRV_TFT connected to the cathode thereof.

The driving thin film transistor SW_TFT has a gate commonly connected to the source of the switching thin film transistor SW_TFT and the storage capacitor Cst, a drain connected to the cathode of the organic light emitting diode OLED, and a source connected to the ground VSS. The driving thin film transistor DRV_TFT passes a voltage and a current applied, via the organic light emitting diode OLED, to the drain thereof in a state turned on by a data voltage supplied via the switching thin film transistor SW_TFT or a voltage supplied from the storage capacitor Cst into the ground connected to the source thereof, thereby driving the organic light emitting diode OLED.

In one embodiment, a current amount passing through the driving thin film transistor DRV_TFT is increased or decreased in proportion to a magnitude of the threshold voltage of the driving thin film transistor DRV_TFT to thereby determine brightness of the organic light emitting diode OLED. For example, when the threshold voltage is increased by a deterioration of the driving thin film transistor DRV_TFT or a peripheral high temperature circumstance, the brightness of the organic light emitting diode OLED is reduced in proportion to the increased threshold voltage. Accordingly, the present OLED display device compensates for a magnitude of the data voltage applied to the gate of the driving thin film transistor DRV_TFT in proportion to the increased threshold voltage, thereby preventing the brightness of the organic light emitting diode OLED from being lowered due to the deterioration of the driving thin film transistor DRV_TFT or the peripheral high temperature circumstance.

The feedback thin film transistor FB_TFT has a gate connected to the scan line SL2-1, a drain connected to the cathode of the organic light emitting diode OLED and the drain of the driving thin film transistor SW_TFT, and a source connected to the feedback line FL1. The feedback thin film transistor FB_TFT is turned on when the second scanning pulse outputted from the gate driver 130 is applied, via the scan line SL2-1, to the gate thereof. In this embodiment, the feedback thin film transistor FB_TFT feeds back a voltage commonly loaded on the cathode of the organic light emitting diode OLED and the drain of the driving thin film transistor SW_TFT into the feedback line FL1 connected to the first data compensator 126-1.

In the OLED display device according to the present embodiment, the switching thin film transistor SW_TFT, the driving thin film transistor SW_TFT and the feedback thin film transistor FB_TFT are implemented by a N-type MOS-FET, but they may be implemented by a P-type MOS-FET without being limited to this.

The first switching unit **126-*a* includes first and second transmission gates TRG1 and TRG2 formed by a combination of a PMOS transistor and a NMOS transistor. A common output terminal of the first and second transmission gates TRG1 and TRG2 is connected to a non-inverted input terminal (+) of the differential amplifier 126-*d*. An input terminal of the first transmission gate TRG1 is supplied with a reference data voltage from the first reference data generator 125-1 while an input terminal of the second transmission gate TRG2 is supplied with a data voltage from the D/A converter 124**.

In this embodiment, the first switching unit **126-*a*, if a high level of compensation control signal CCS and a low level of inverted compensation control signal /CCS are supplied from the timing controller 150, then the high-level compensation control signal turns on the NMOS transistor of the first transmission gate TRG1 and, at the same time, turns off the PMOS transistor of the second transmission gate TRG2. The low-level inverted compensation control signal /CCS turns on the PMOS transistor of the first transmission gate TRG1 and, at the same time, turns off the NMOS transistor of the second transmission gate TRG2, thereby turning on the first transmission gate TRG1 and turning off the second transmission gate TRG2. Accordingly, the reference data voltage from the first reference data generator 125-1 applied to the first transmission gate TRG1 is switched to thereby supply it to the non-inverted input terminal (+) of the differential amplifier 126-*d* and, at the same time, a data voltage from the D/A converter 124 applied to the second transmission gate TRG2** is shut off.

In an alternate embodiment, if a low level of compensation control signal CCS and a high level of inverted compensation control signal /CCS are supplied from the timing controller 150, then the low-level compensation control signal turns off the NMOS transistor of the first transmission gate TRG1 and, at the same time, turns on the PMOS transistor of the second transmission gate TRG2. The high-level inverted compensation control signal /CCS turns off the PMOS transistor of the first transmission gate TRG1 and, at the same time, turns on the NMOS transistor of the second transmission gate TRG2, thereby turning off the first transmission gate TRG1 and turning on the second transmission gate TRG2. Accordingly, the reference data voltage from the first reference data generator 125-1 applied to the first transmission gate TRG1 is shut off and, at the same time, a data voltage from the D/A converter 124 applied to the second transmission gate TRG2 is switched to thereby supply it to the non-inverted input terminal (+) of the differential amplifier 126-*d*.

The second switching device 126-*b* includes third and fourth transmission gates TRG3 and TRG4 formed by a combination of a PMOS transistor and a NMOS transistor. A common output terminal of the third and fourth transmission gates TRG3 and TRG4 is connected to an inverted input terminal (−) of the differential amplifier 126-*d*, and an input terminal of the first transmission gate TRG1 is connected to the feedback line FL1 while an input terminal of the second transmission gate TRG2 is connected to the output terminal of the differential 832 amplifier 126-*d*.

In this embodiment, a high level of compensation control signal CCS and a low level of inverted compensation control signal /CCS are supplied from the timing controller 150, then the high-level compensation control signal turns on the NMOS transistor of the third transmission gate TRG3 and, at the same time, turns off the PMOS transistor of the fourth transmission gate TRG4. The low-level inverted compensation control signal /CCS turns on the PMOS transistor of the third transmission gate TRG3 and, at the same time, turns off the NMOS transistor of the fourth transmission gate TRG4, thereby turning on the third transmission gate TRG3 and turning off the fourth transmission gate TRG4. Accordingly, the feedback voltage fed back through the feedback line FL1 is switched by the third transmission gate TRG3 to thereby supply it to an inverted input terminal (−) of the differential amplifier 126-*d* and, at the same time, a switching of the negative feedback voltage fed back from the output terminal of the differential amplifier 126-*d* is shut off by the fourth transmission gate TRG4.

In another embodiment, if a low level of compensation control signal CCS and a high level of inverted compensation control signal /CCS are supplied from the timing controller 150, then the low-level compensation control signal turns off the NMOS transistor of the third transmission gate TRG3 and, at the same time, turns on the PMOS transistor of the fourth transmission gate TRG4. The high-level inverted compensation control signal /CCS turns off the PMOS transistor of the third transmission gate TRG3 and, at the same time, turns on the NMOS transistor of the fourth transmission gate TRG4, thereby turning off the third transmission gate TRG3 and turning on the fourth transmission gate TRG4. Accordingly, a switching of the feedback voltage applied to the third transmission gate TRG3 is shut off and, at the same time, the negative feedback voltage fed back from the output terminal of the differential amplifier 126-*d* is switched by the fourth transmission gate TRG4 to supply it to the inverted input terminal (−) of the differential amplifier 126-*d*.

The reset unit 126-*c* is configured by a resetting NMOS transistor RS_TR which has a gate supplied with an inverted compensation control signal /CCS from the timing controller 150, a drain connected to the feedback line FL1, and a source connected to the ground. In such a reset unit 126-*c*. If a low level of inverted compensation control signal /CCS is applied from the timing controller 150, then the resetting NMOS transistor RS_TR is turned off to fail to serve a reset function. Alternatively, if a high level of inverted compensation control signal /CCS is applied from the timing controller 150, then the resetting NMOS transistor RS_TR is turned on to switch a voltage loaded on the feedback line FL1 connected to the drain thereof into the ground. As a result, the reset unit 126-*c* resets the feedback line FL1. Accordingly, the present OLED display device can more accurately control the driving voltage of the organic light emitting diode OLED with the aid of the feedback voltage by resetting all of the voltages loaded on the feedback line FL1 before detecting the feedback voltage.

The differential amplifier 126-*d* has an non-inverted inverted input terminal (+) connected to the output terminal of the first switching unit 126-*a*, an inverted input terminal (−) connected to the output terminal of the second switching unit 126-*b*, and an output terminal connected to the data line DL1. The output terminal of the differential amplifier 126-*d* is negative feedback into the input terminal of the second switching unit 126-*b*. The differential amplifier 126-*d* outputs a data voltage switched by the first switching device 126-*a* or a reference data voltage to the data line DL1 when a negative feedback is made between the output terminal and the inverted input terminal (−) thereof by way of the second switching device 126-*b*. For example, if the negative feedback between the output terminal and the inverted input terminal (−) is shut off and, at the same time, the feedback voltage fed back through the feedback line FL1 is switched by the second switching unit 126-*b* to be applied to the inverted input terminal (−) of the differential amplifier 126-*d*, then the differential amplifier 126-*d* makes a differential amplification of the data voltage switched by the first switching 126-*a* or the reference data voltage on the basis of the feedback voltage inputted, via the second switching device 126-*b*, to the inverted input terminal (−) thereof, thereby outputting it to the data line DL1.

A driving procedure of the present OLED display device having the above-mentioned configuration will be described in more detail with reference to the attached flow charts.

Figure 6A:
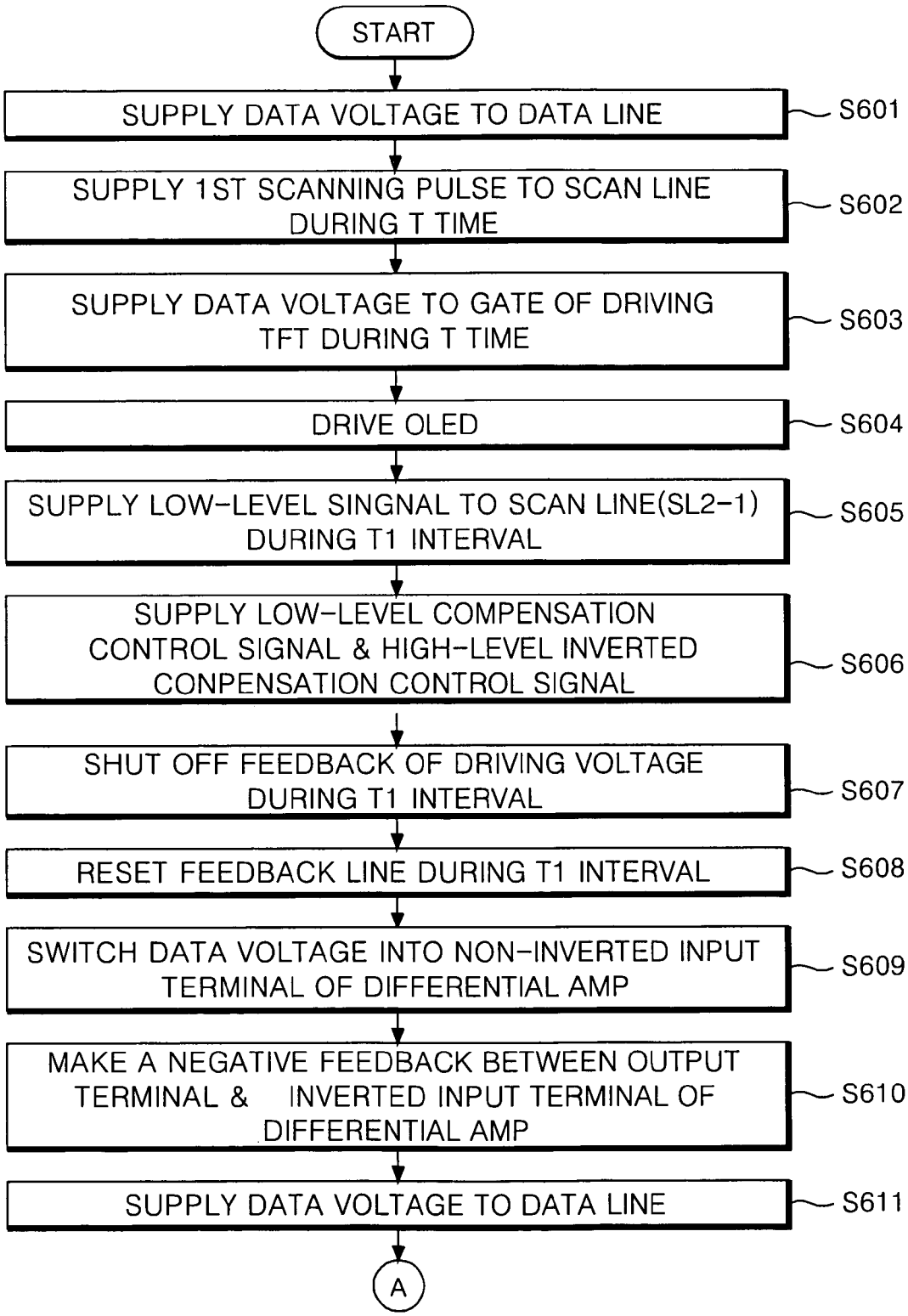
FIG. 6A and FIG. 6B are flow charts that illustrate a method of driving the organic light emitting diode display device according to one embodiment.
Figure 6B:
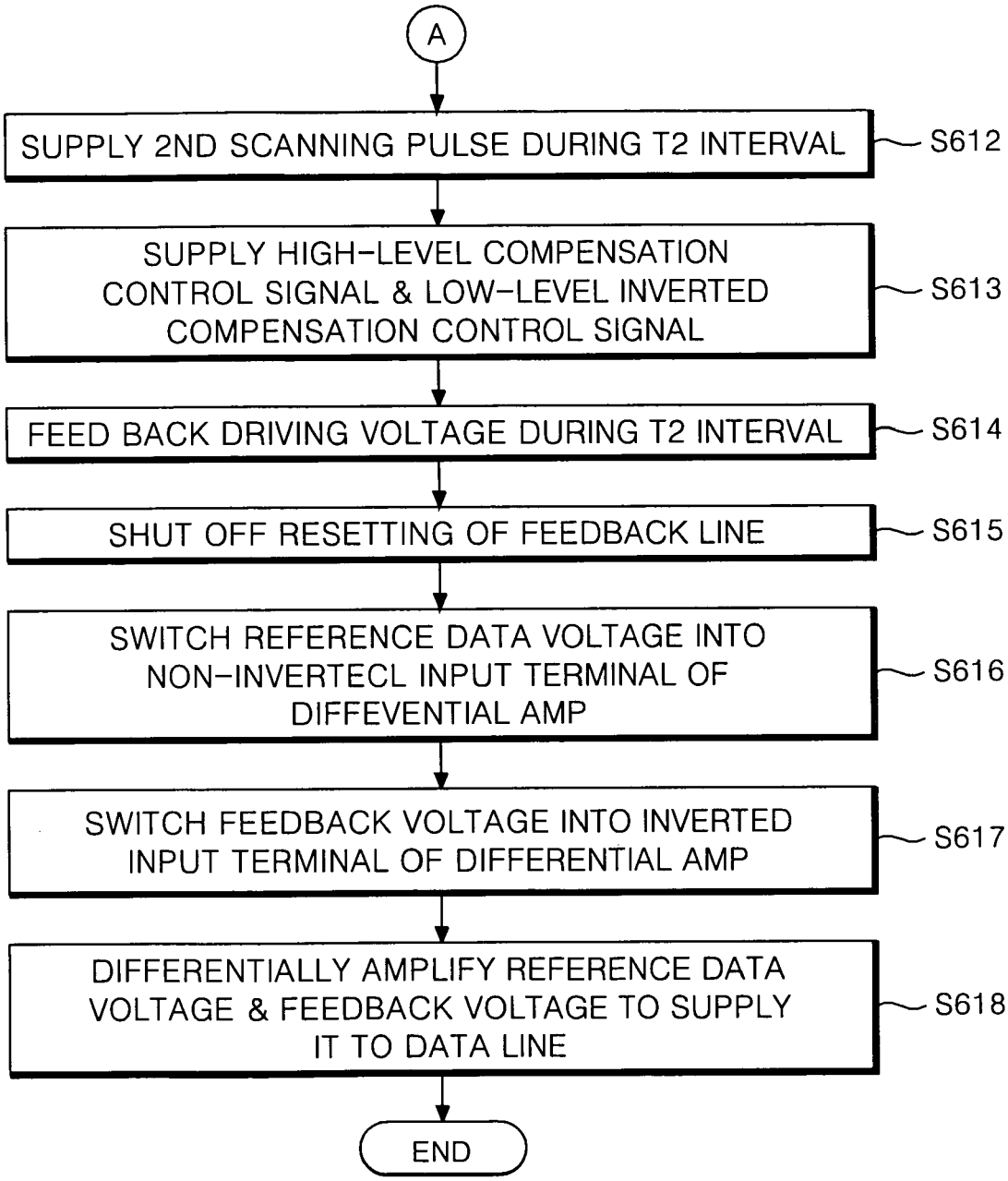

FIG. 6A and FIG. 6B are flow charts that illustrate a method of driving the organic light emitting diode display device according to one embodiment, which illustrate a pixel commonly connected to the scan lines SL1-1 and SL2-1, the data line DL1 and the feedback line FL1 of the plurality of pixels and a driving process of the first data compensator 126-1 that supplies a data voltage to this pixel.

In one embodiment, as shown in FIG. 6A and FIG. 6B, at S601, the first data driver 126-1 supplies a data voltage from the D/A converter 124 to the pixel connected to the data line DL1. In this embodiment, for example, if the first gate driver 130 supplies a first scanning pulse to the scan line SL1-1 during a T time as shown in FIG. 7 under control of the timing controller 150 at S602, then the switching thin film transistor SW_TFT of the pixel is turned on during a T time by the first scanning pulse to switch a data voltage supplied to the data line DL1, thereby supplying it to the storage capacitor Cst and the gate of the driving thin film transistor DRV_TFT at S603.

At S604, the storage capacitor Cst is charged by a voltage supplied via the switching thin film transistor SW_TFT and, at the same time, the driving thin film transistor DRV_TFT is turned on by this voltage, thereby driving the organic light emitting diode OLED.

Figure 7:
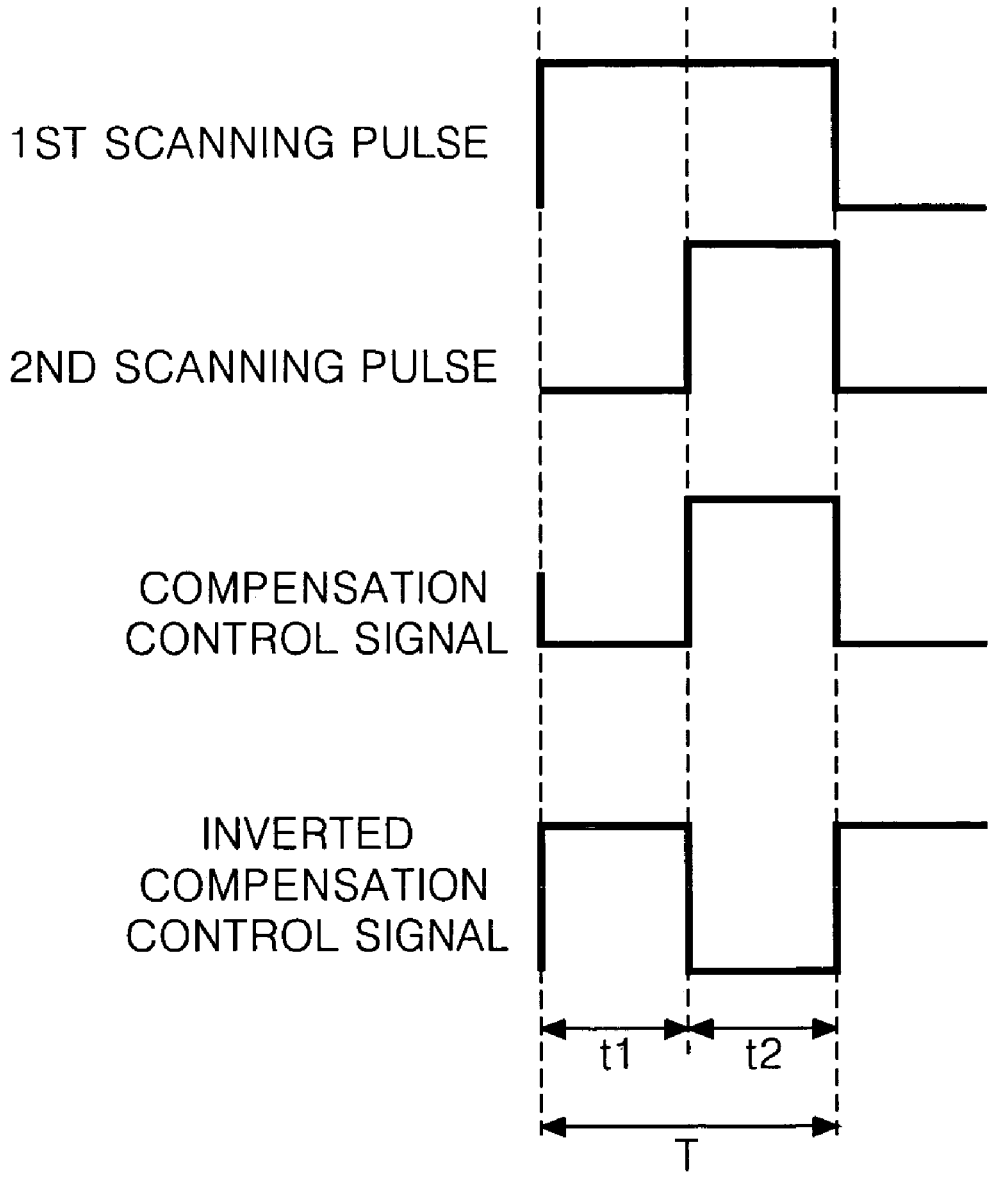
FIG. 7 is a timing diagram that illustrates a driving procedure of the organic light emitting diode display device according to one embodiment.

In the state in which the first scanning pulse is being supplied to the scan line SL1-1 during the T time as described above, during a t1 time corresponding to a half of the T time shown in FIG. 7, the second gate driver 130 applies a low-level signal to the scan line SL2-1 under control of the timing controller 150 at S605. The timing controller 150 applies a low-level compensation control signal CCS to the first and second switching units 126-*a* and 126-*b* and, at the same time, applies a high-level level inverted compensation control signal /CCS to the first and second switching units 126-*a* and 126-*b* and the reset unit 126-*c* at S606. The feedback thin film transistor FB_TFT is turned off during a t1 interval by a low-level signal from the second gate driver 140 to thereby shut off a feeding back of the driving voltage of the organic light emitting diode OLED at S607. In this shut-off feedback state, the resetting TMOS transistor RS_TR of the reset unit 126-*c* is turned on by a high-level inverted compensation control signal /CCS from the timing controller 150 to switch a voltage loaded on the feedback line FL1 into the ground during the t1 interval, thereby resetting the feedback line FL1 at S608. During the t1 interval, the low-level compensation control signal CCS and the high-level inverted compensation control signal /CCS turns off the first transmission gate TRG1 of the first switching unit 126-*a* and turn on the second transmission gate TRG2 thereof to switch the data voltage into the non-inverted input terminal (+) of the differential amplifier 126-*d* at S609 while turning off the third transmission gate TRG3 of the second switching unit 126-*b* and turning on the fourth transmission gate TRG4 thereof, thereby making a negative feedback between the output terminal and the non-inverted input terminal (−) of the differential amplifier 126-*d* at S610.

Figure 8A:
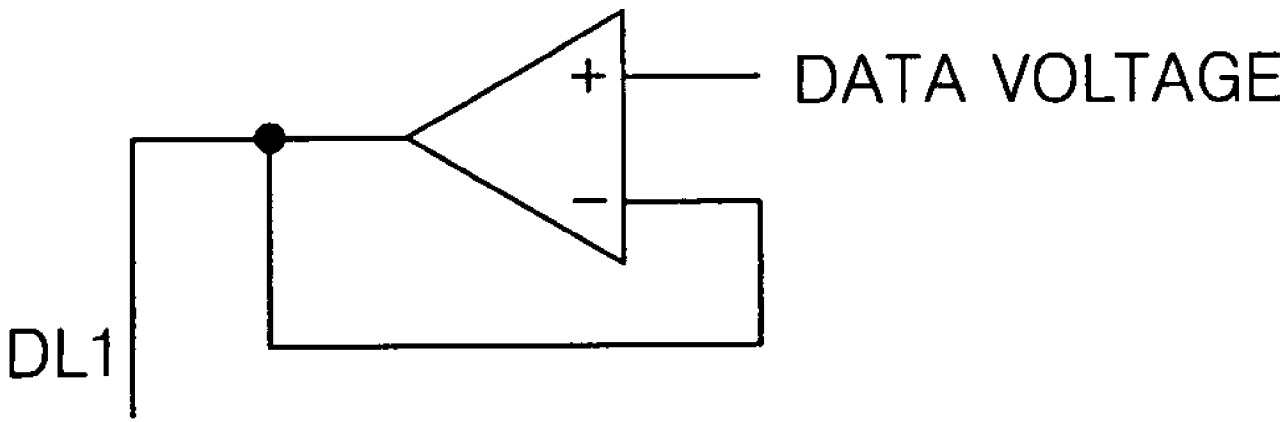
FIG. 8A illustrates an equivalent circuit diagrams of the data driver.

For example, during the t1 interval as shown in FIG. 7, the timing controller 150 supplies a low-level compensation control signal CCS and a high-level inverted compensation control signal /CCS to thereby form an equivalent circuit as shown in FIG. 8A within the first data driver 126-1. In the case of forming this equivalent circuit, the differential amplifier 126-*d* supplies the data voltage to inputted the non-inverted input terminal (+) thereof by a negative feed back between the output terminal and the inverted input terminal (−) thereof to the data line DL1 at S611. In this embodiment, the differential amplifier 126-*d* carries out an output buffer function.

During a t2 interval after the lapse of the t1 interval as shown in FIG. 7, the second gate driver 130 applies a second scanning pulse to the scan line SL2-1 at a step S512 under control of the timing controller 150. The timing controller 150 applies a high-level compensation control signal CCS to the first and second switching units 126-*a* and 126-*b* and, at the same time, applies a low-level inverted compensation control signal /CCS to the first and second switching units 126-*a* and 126-*b* and the reset unit 126-*c* at S613. Accordingly, the feedback thin film transistor FB_TFT is turned on during the t2 interval by a second scanning pulse from the second gate driver 140 to thereby feed back a driving voltage of the organic light emitting diode OLED through the feedback line FL1 at S614. In this fed back voltage state, the resetting TMOS transistor RS_TR of the reset unit 126-*c* is turned off by a low-level inverted compensation control signal /CCS from the timing controller 150 to thereby shut off a resetting of the feedback line FL1 at S615.

During the t2 interval, the high-level compensation control signal CCS and the low-level inverted compensation control signal /CCS from the timing controller 150 turn on the first transmission gate TRG1 of the first switching unit 126-*a* and turn off the second transmission gate TRG2 to thereby switch a reference data voltage from the first reference data generator 125-1 into the non-inverted input terminal (+) of the differential amplifier 126-*d* at S616; and turn on the third transmission gate TRG3 of the second switching unit 126-*b* to switch a feedback voltage fed back through the feedback line FL1 into the inverted input terminal (−) of the differential amplifier 126-*d* and, at the same time, turn off the fourth transmission gate TRG4 to shut off a negative feedback between the output terminal and the inverted input terminal (−) of the differential amplifier 126-*d* at S617.

Figure 8B:
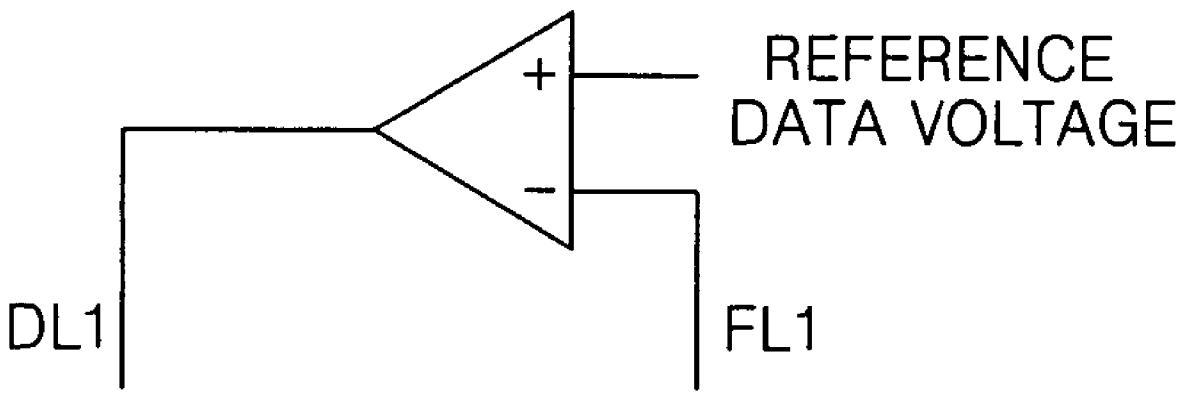
FIG. 8B illustrates an equivalent circuit diagram of the display panel configuring the organic light emitting diode display device.

For example, during the t2 interval as shown in FIG. 7, the timing controller 150 supplies a high-level compensation control signal CCS and a low-level inverted compensation control signal /CCS to thereby form an equivalent circuit in which a reference data voltage from the first reference data generator 125-1 and a feedback voltage are supplied to the non-inverted input terminal (+) and the inverted input terminal (−) of the differential amplifier 126-*d* as shown in FIG. 8B within the first data compensator 126-1. In the case of forming this equivalent circuit, the differential amplifier 126-*d* makes a differential amplification of the reference data voltage inputted to the non-inverted input terminal (+) thereof on a basis of the feedback voltage inputted to the inverted input terminal (−) thereof to supply it to the data line DL1 at S618.

As described above, when the threshold voltage value of the driving thin film transistor DRV_TFT is raised to reduce the driving voltage of the organic light emitting diode OLED, the present OLED display device feeds back this driving voltage, and automatically compensates for the driving voltage of the organic light emitting diode OLED in accordance with a magnitude of the fed-back voltage.

Alternatively, if the feedback thin film transistor FB_TFT is added within the pixel, then there is raised a problem in that a size of the pixel is increased and the aperture ratio is reduced. But, if the present embodiments are implemented using a top emission that forms a transparent electrode at an upper portion and an opaque transparent electrode at a lower portion, and forms an organic light emitting layer between the transparent electrode of the upper portion and the opaque transparent electrode of the lower portion to thereby emit a light toward a transparent electrode positioned the upper portion, then the size of the pixel and the aperture ratio are not changed although the feedback thin film transistor FB_TFT is added within the pixel.

As described above, according to the present embodiment, when the threshold voltage value of the driving thin film transistor is deteriorated due to, for example, a direct current voltage or is raised due to, for example, a peripheral high temperature circumstance to reduce the driving voltage of the organic light emitting diode OLED, the data voltages supplied to the data lines are controlled in accordance with a magnitude of the feedback voltage made by a feeding back operation of the driving voltage of the organic light emitting diode.

In one embodiment, voltage supplied to the gate of the driving thin film transistor is increased in proportion to the raised threshold voltage value to thereby automatically compensate for the driving voltage of the organic light emitting diode. Accordingly, it becomes possible to prevent brightness of the organic light emitting diode from being reduced due to, for example, deterioration of the driving thin film transistor or due to, for example, a peripheral high temperature circumstance.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An organic light emitting diode display device, comprising:

a display panel including a plurality of first and second scan lines and a plurality of data lines, a plurality of pixels provided at intersections between the plurality of first and second scan lines and the plurality of data lines and a plurality of feedback lines connected to the plurality of pixels;

a timing controller;

a first gate driver;

a second gate driver; and a data driver that generates a plurality of data voltages that have a level proportional to a gray scale level of a digital data supplied from the timing controller, and supplies the data voltages to the plurality of data lines and compensates for the data voltages in accordance with a magnitude of the feedback voltages from the plurality of pixels fed back through the plurality of feedback lines under control of the timing controller, wherein the data driver includes:

a plurality of reference data generators that generate a plurality of reference data voltages having a level that is proportional to a gray scale level of a digital data supplied from the timing controller; and a plurality of data compensators that supply a data voltage to the data line connected to itself among a plurality of data lines and making a differential amplification of a reference data voltage applied to itself among reference data voltages from the plurality of reference data generators on the basis of a feedback voltage fed back through a feedback line connected to itself among a plurality of feedback lines to the data line under control of the timing controller; and wherein each of the plurality of data compensators includes:

a first switching device that selectively switches the reference data voltage and the data voltage in response to first and second control signals supplied from the timing controller;

a second switching device that selectively switches the feedback voltage from the pixel connected to itself and a negative feedback voltage from the output terminal thereof in response to the first and second control signals;

a reset unit that resets the feedback line connected to itself in response to the second control signal; and a differential amplifier that makes a differential amplification of a voltage switched by the first switching device and a voltage switched by the second switching device to supply it to the data line.

2. The organic light emitting diode display device according to claim 1, wherein each of the plurality of pixels includes:

a first switching device being turned on by a first scanning pulse, to switch the data voltage supplied to the data line;

a storage capacitor that charges the voltage supplied by the first switching device;

an organic light emitting diode that receives a driving current generated by a high-level electric potential supply voltage to make an organic light emission;

a second switching device being turned on by a voltage applied via the first switching device or a voltage supplied from the storage capacitor, to drive the organic light emitting diode; and a third switching device being turned on by a second scanning pulse, to switch the driving voltage of the organic light emitting diode into the feedback line.

3. The organic light emitting diode display device according to claim 2, wherein the third switching device is a thin film transistor having:

a gate connected to the second scan line, a drain commonly connected to the second switching device and the organic light emitting diode, and a source connected to the feedback line.

4. The organic light emitting diode display device according to claim 1, wherein the first switching device includes first and second transmission gates formed by a combination of a PMOS transistor and a NMOS transistor, and wherein a common output terminal of the first and second transmission gates is connected to a non-inverted input terminal of the differential amplifier, an input terminal of the first transmission gate is supplied with a reference data voltage from a reference data generator that corresponds to itself among a plurality of reference data generators, and an input terminal of the second transmission gate is supplied with the data voltage.

5. The organic light emitting diode display device according to claim 4, wherein the second switching unit includes third and fourth transmission gates formed by a combination of a PMOS transistor or a NMOS transistor, and a common output terminal of the third and fourth transmission gates is connected to an inverted input terminal of the differential amplifier, an input terminal of the third transmission gate is connected to the feedback line, and an input terminal of the fourth transmission gate is connected to the output terminal of the differential amplifier.

6. The organic light emitting diode display device according to claim 5, wherein the reset unit includes:

a NMOS transistor having a gate supplied with the second control signal, a drain connected to the feedback line and a source connected to a ground.

7. An organic light emitting diode display device, comprising:

a display panel including a plurality of first and second scan lines and a plurality of data lines and a plurality of pixels connected to a plurality of feedback lines, wherein each of the plurality of pixels includes a first switching device being turned on by a first scanning pulse supplied to the first scan line to switch a data voltage supplied to the data line;

a storage capacitor that charges the voltage supplied by the first switching device;

an organic light emitting diode that receives a driving current generated by a high-level electric potential supply voltage to make an organic light emission;

a second switching device being turned on by a voltage applied via the first switching device or a voltage supplied from the storage capacitor to drive the organic light emitting diode; and a third switching device being turned on by a second scanning pulse supplied to the second scan line to switch the driving voltage of the organic light emitting diode into the feedback line.

8. The organic light emitting diode display device according to claim 7, wherein the third switching device is a thin film transistor comprising:

a gate connected to the second scan line, a drain commonly connected to the second switching device and the organic light emitting diode, and a source connected to the feedback line.

9. An organic light emitting diode display device, comprising:

a data driver that supplies a data voltage to a data line, the data driver being configured by a plurality of data compensators that compensate for the data voltage in accordance with a magnitude of a feedback voltage from the pixel fed back through the feedback line in response to a control of a timing controller, the plurality of data compensators comprising:

a first switching device that switches a reference data voltage and a data voltage in response to first and second control signals from the timing controller;

a second switching device that switches the feedback voltage and a negative feedback voltage from the output terminal thereof in response to the first and second control signals; and a differential amplifier that makes a differential amplification of a voltage switched by the first switching device and a voltage switched by the second switching device and supplies it to the data line.

10. The organic light emitting diode display device according to claim 9, wherein the first switching device includes first and second transmission gates formed by a combination of a PMOS transistor and a NMOS transistor, and wherein a common output terminal of the first and second transmission gates is connected to a non-inverted input terminal of the differential amplifier, an input terminal of the first transmission gate is supplied with the reference data voltage and an input terminal of the second transmission gate is supplied with the data voltage.

11. The organic light emitting diode display device according to claim 10, wherein the second switching device comprises third and fourth transmission gates formed by a combination of a PMOS transistor and a NMOS transistor, and wherein a common output terminal of the third and fourth transmission gates is connected to an inverted input terminal of the differential amplifier, an input terminal of the third transmission gate is connected to the feedback line, and an input terminal of the fourth transmission gate is connected to the output terminal of the differential amplifier.

12. The organic light emitting diode display device according to claim 11, further comprising:

a reset unit that resets the feedback line in response to the second signal.

13. The organic light emitting diode display device according to claim 12, further comprising:

a NMOS transistor comprising a gate supplied with the second control signal, a drain connected to the feedback line and a source connected to a ground.

14. A method of driving an organic light emitting diode display device, comprising:

generating a first scanning pulse and supplying it to a first scan line connected to a pixel;

supplying a data voltage to a data line connected to the pixel selected by the first scanning pulse;

generating a second scanning pulse and supplying it to a second scan line connected to the pixel;

generating a reference data voltage comprising a level that is proportional to a gray scale level of the inputted digital data;

feeding back a voltage of the pixel through a feedback line during an application time of the second scanning pulse; and compensating for the data voltage supplied to the data line in accordance with a magnitude of a voltage fed back by using the reference data voltage, wherein the compensating for the data voltage comprises:

feeding back a voltage of the pixel through a feedback line during an application time of the second scanning pulse; and resetting the feedback line prior to an application of the second scanning pulse.

15. The method according to claim 14, wherein compensating for the data voltage comprises:

making a differential amplification of a reference data voltage on the basis of the feedback to supply it to the data line.

* * * * *